US005760350A

United States Patent [19]

Pepin et al.

[11] Patent Number: 5,760,350

[45] Date of Patent: Jun. 2, 1998

[54] MONITORING OF ELEVATOR DOOR PERFORMANCE

[75] Inventors: Ronald R. Pepin, Windsor Locks; Robert Mashiak, Somers; Sanjay Kamani, Unionville; Patrick Lusaka, Windsor, all of Conn.; Jean-Marie Rennetaud, Dierikom, Switzerland

[73] Assignee: Otis Elevator Company, Farmington, Conn.

[21] Appl. No.: 738,667

[22] Filed: Oct. 25, 1996

[51] Int. Cl.[6] ..... B66B 13/14; B66B 1/34

[52] U.S. Cl. ..... 187/316; 187/393

[58] Field of Search ..... 187/316, 391, 187/393

[56] References Cited

U.S. PATENT DOCUMENTS

| | | | |
|---|---|---|---|
| 3,973,648 | 8/1976 | Hummert et al. | 187/29 R |
| 4,568,909 | 2/1986 | Whynacht | 340/21 |
| 4,622,538 | 11/1986 | Whynacht et al. | 340/506 |
| 4,727,499 | 2/1988 | Tsuji | 364/554 |
| 4,750,591 | 6/1988 | Coste et al. | 187/130 |
| 4,930,604 | 6/1990 | Schienda et al. | 187/133 |
| 5,235,143 | 8/1993 | Bajat et al. | 187/103 |
| 5,445,245 | 8/1995 | Ketoviita | 187/391 |

FOREIGN PATENT DOCUMENTS

| | | | |
|---|---|---|---|
| WO9608437 | 3/1996 | WIPO | B66B 3/00 |

OTHER PUBLICATIONS

Copy of U.S. Patent Application Serial No. 08/740,601 entitled "Monitoring of Manual Elevator Door Systems" filed Oct. 31, 1996, Sanjay Kamani, et al.

Copy of U.S. Patent Application Serial No. 08/757,306 entitled "Monitoring of Elevator Door Reversal Data" filed Nov. 27, 1996, Sanjay Kamani, et al.

*Primary Examiner*—Robert Nappi

[57] ABSTRACT

An apparatus and method for providing an elevator door performance result of an elevator door in an elevator door system which normally operates sequentially from state-to-state in a closed loop sequential chain of normal operating states is disclosed. A plurality of parameter signals provided by the elevator door system is monitored by the apparatus. The apparatus comprises: a door state sequencer for providing a performance measure; a module for providing a reference measure and an acceptable range; and an abnormal detection module for analyzing the door performance measure.

36 Claims, 5 Drawing Sheets

VECTOR PRIORITIES WHEN EXITING STATE
V# DENOTES VECTOR AND PRIORITY
0=HIGHEST PRIORITY
9=LOWEST PRIORITY

LEGEND OF DOOR STATUS OUTPUT

- ○ DOOR CLOSED–NODES DCLS
- ○ DOOR OPEN–STATES DOP, DCC
- ○ DOOR CLOSING–NODES DSOWC,DNIS
- ○ DOOR COMMANDED OPEN NODE DCO

MONITORING OF ELEVATOR DOOR PERFORMANCE

TECHNICAL FIELD

The present invention relates to elevator door monitoring and, more particularly, providing elevator door performance data.

BACKGROUND OF THE INVENTION

Any number of systems operating at a plurality of remote sites may be monitored using sensors at the remote sites and transmitting information on the present status of a number of parameters during the systems' operation at the sites, such as an elevator door system in a plurality of remote buildings. In conventional remote monitoring systems, the parameters are analyzed by a signal processor so as to determine if any parameters have changed state. If so, the present value of the changed parameter is plugged into a Boolean expression defining an alarm condition in order to determine if the Boolean expression is satisfied and hence the alarm condition is present. If so, an alarm condition is transmitted and displayed as an alarm message. Each data point of each parameter is transmitted independently of other data points and a fixed threshold is used to indicate the presence of an alarm. This approach focuses on alarm data and provides little information concerning performance degradation. Thus, this approach makes it difficult to determine or detect degradation of door performance over a period of time.

An additional difficulty is presented by the large number of different parameters which need to be analyzed resulting from the large number of available elevator door operating systems. Conventional remote monitoring systems are not well equipped to handle the large variety in the parameters to be monitored.

Consequently, a system and a method for monitoring these elevator door systems that avoids the above-mentioned drawbacks is clearly desirable.

DISCLOSURE OF THE INVENTION

It is an object of the present invention to provide an apparatus and method which provides an improved method of monitoring an elevator door system.

It is a further object of the present invention to provide an apparatus and method which monitors elevator door performance in addition to monitoring alarm conditions caused by elevator door faults.

It is another object of the present invention to provide an apparatus and method for monitoring a plurality of different elevator door systems having a plurality of parameter signals to be monitored.

In accordance with the present invention, an apparatus provides an elevator door performance result of an elevator door in an elevator door system. The elevator door system normally operates sequentially from state-to-state in a closed loop sequential chain of normal operating states. The apparatus monitors a plurality of parameter signals provided by the elevator door system. The apparatus comprises a door state sequencer for providing a performance measure in response to a plurality of parameter signals provided by the elevator door system; a module for providing a reference measure and an acceptable range for the door performance measure in response to the sequential chain of normal door operating states; and an abnormal detection module for analyzing the door performance measure such that if the door performance measure is within the acceptable range a performance result is provided by averaging the performance measure with the reference measure.

In further accordance with the present invention, a method for providing an elevator door performance result of an elevator door in an elevator system comprising the steps of: determining a reference measure for the elevator door; determining an acceptable range for a performance measure in response to the reference measure; providing the performance measure from a door state machine which monitors a plurality of parameter signals provided by the elevator door system, the door state machine following a sequence of elevator door operations; determining if the performance measure is within the acceptable range; and providing a performance result by averaging the performance measure with the reference measure if the performance measure is within the acceptable range.

BEST MODE FOR CARRYING OUT THE INVENTION

Remote Monitoring System

Figure 1:
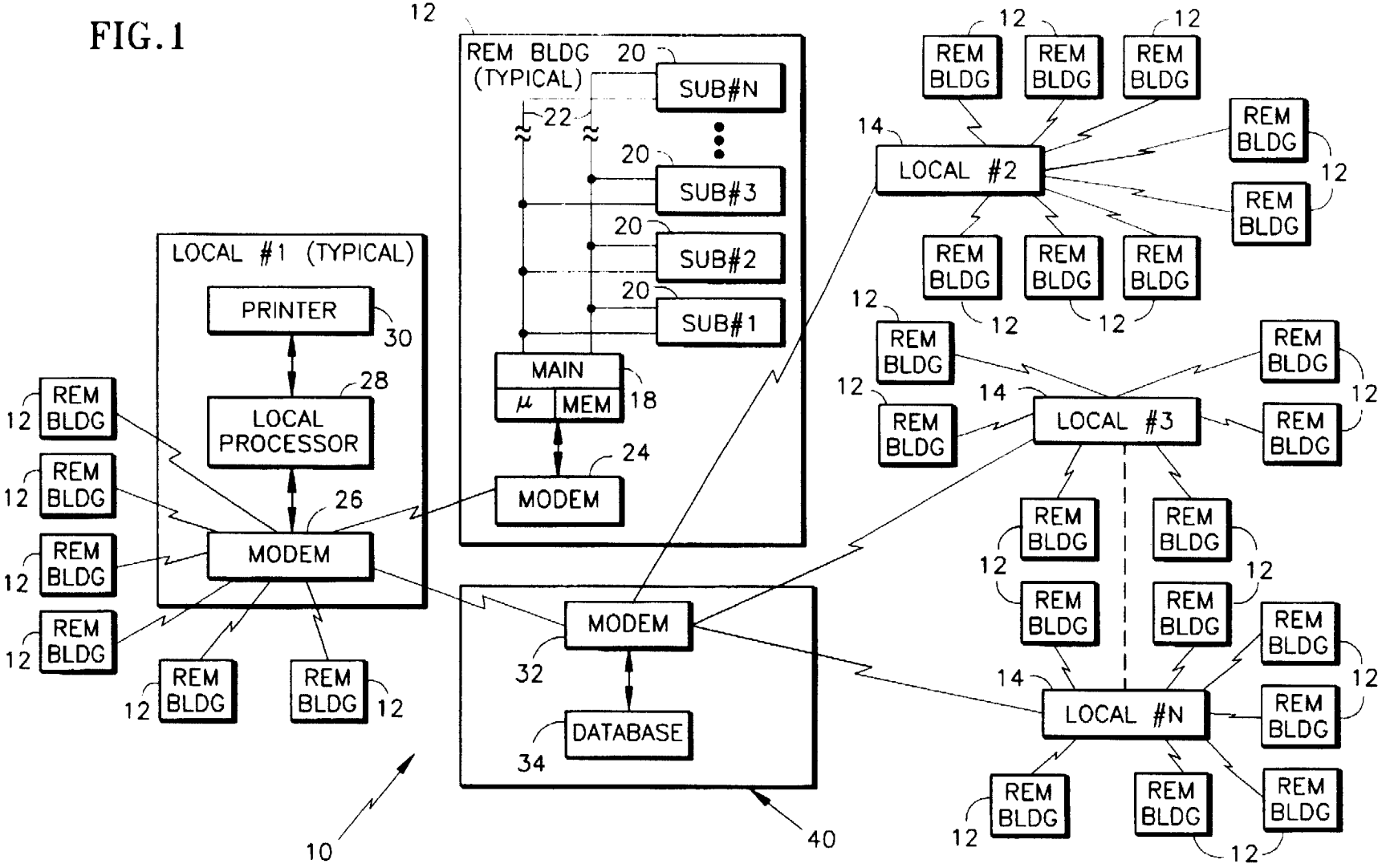
FIG. 1 is an illustration of an elevator monitoring system.

FIG. 1 illustrates the present remote elevator monitoring system 10 for monitoring individual elevators in remotely located buildings 12, for transmitting alarm and performance information to associated local monitoring centers 14. The method of communication between the remote buildings and the various local offices is a bi-directional communication system whereby inoperative elevators are identified and individual elevator door performance information is transferred to a local monitoring center through the use of local telephone lines which may include radio frequency transmission paths. It should be understood that although the remote elevator monitoring system disclosed herein utilizes the public switch telephone network available within the local community in which a particular local monitoring center and its associated remote buildings are located, other equivalent forms of communication may be utilized. For example, other communication systems such as an Internet or Intranet communication system may be used with the present invention.

Each remote building of the remote elevator monitoring system includes a main 18 and one or more subordinates 20. The individual subordinates 20 are directly attached to sensors associated with an associated elevator and elevator door. The subordinates 20 transmit signals indicative of the status of selected parameters via a communication line 22 which comprises a pair of wires. The use of a two wire communications line between the main 18 and its associated subordinates 20 provides both an inexpensive means of data transmission and the ability to inexpensively dispose the main in a location remote from the subordinates. For instance, if all of the subordinates are located in the elevator machine room having a hostile environment on top of an elevator shaft, the main may be inexpensively located in a more benign environment in the building. Although the architecture of the remote elevator monitoring system within a remote building has been described as having a main communicating with one or more subordinates using an efficient two-wire communication line, it should be understood by those skilled in the art that other means of data communication and transmission including less efficient means may also be used. It should also be understood that because of the number of subordinates capable of being attached to a given communication line is finite, it may be necessary within a given remote building to utilize more than one main-subordinate group.

Each main 18 includes a microprocessor which evaluates the performance data and determines whether an alarm condition exists according to a state machine model which is coded within the software of the microprocessor. The microprocessor through signal processors conditions the inputs provided by each subordinate 20. These inputs are then used by a state machine to determine the status of the doors as is explained herein below. As a result of the direct connection of the subordinates to the sensors, the state machine is directly responsive to the actual devices that are being monitored. Thus, any errors which may be introduced by an elevator controller are avoided. This is an advantage over conventional remote monitoring systems which are indirectly responsive to the sensors via elevator controller inputs. As the inputs are processed by the microprocessor various events and conditions are recorded and stored in the memory.

In one embodiment, each subordinate also includes a microprocessor which evaluates the performance data and determines whether an alarm condition exists according to a state machine model which is coded within the software of the microprocessor.

Each of the remote buildings 12 communicates with its associated local monitoring center 14 to provide an alarm and the performance data. More specifically, each main 18 communicates with a modem 24 which transmits alarm and performance data to a modem 26 in the associated local monitoring center 14. The local processor 28 stores the retrieved data internally and alerts local personnel as to the existence of an alarm condition and performance data useful for determining the cause of the alarm. The local processor 28 alerts local personnel of these conditions via printer 30. It should be understood that other means of communicating with local personnel, such as a CRT may as easily be used. It should be understood that although a printer and a CRT are shown for use with the invention, the use of only one of them would be sufficient. Each local processor 28 may transmit alarm and performance data via the modem 26 to another modem 32 located in a data storage unit 40. The alarm and performance data may then be stored in a database 34 for long term evaluation. Although bulk data storage is a desirable feature of the present invention, it should be understood that bulk data storage for the purpose of long term performance evaluation is not absolutely essential for the practice of the present invention. Of course, it should be recognized by those skilled in the art that the present invention may be used in a variety of monitoring systems.

Door Diagnostic Logic

Figure 2:
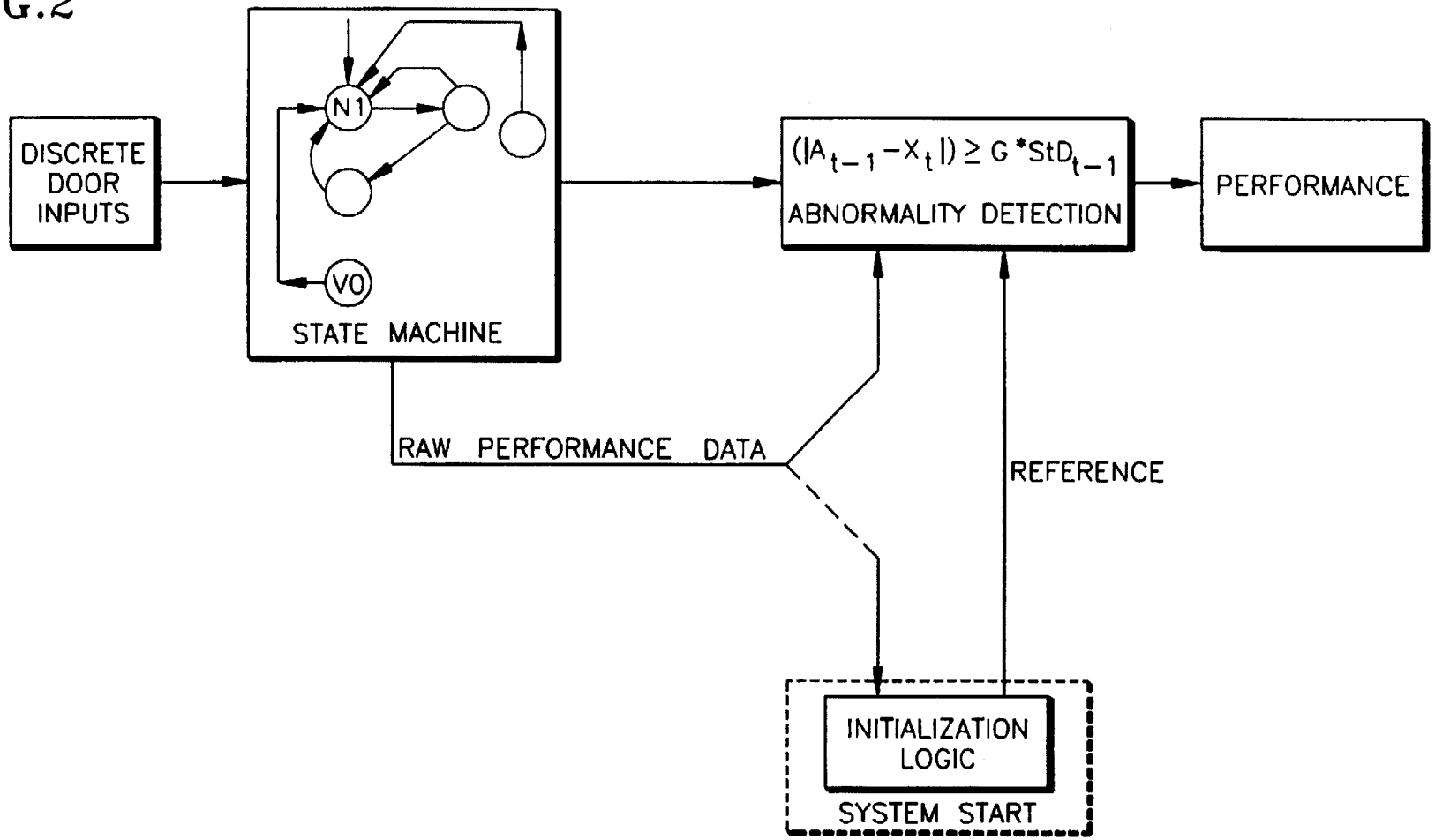
FIG. 2 is a simplified block diagram of a door diagnostic logic according to the present invention.

Referring to FIG. 2, a door diagnostic logic is implemented in each main 18. Alternatively, the door diagnostic is implemented in the main 18 and each subordinate 20. The function of the door diagnostic logic is to capture and store door diagnostic data. Accordingly, the door diagnostic logic requires access to a number of door signals as well as other existing remote elevator monitoring signals as is described below. Off-site data analysis algorithms are used to captured data to perform door diagnostics. The door diagnostic logic is separated into three modules; namely, an initialization logic, an abnormality detection logic and a door state machine.

The initialization logic is designed to set the initial conditions and is implemented as the remote elevator monitoring system is started in order to provide a statistically robust reference data set for use in the abnormality detection logic.

The abnormality detection logic is designed to maintain statistically valid mean and standard deviation values for specific intervals within the door system. The logic uses the previous mean and standard deviation and the state machine to qualify a new data point that is processed by the state machine for a door. If the data point is determined to be normal, that data point is used to update the current mean and standard deviation calculations.

The door state machine is a sequence model of the door system. Accordingly, the door state machine is also defined as a door state sequencer. The door state machine models the different states of door operation. Each state is a result of the previous state and a given condition (i.e. change of an input) which was achieved. The selection of the correct sequences for each door system is based on the available door signals. There are three classes of automatic door systems that are monitored, each of which have different door signals. Thus, the required signals are different for each door state machine and each class of door system is modeled by a different state machine based on the signals available at the door system. The three classes of door types are:

1) Automatic doors with door open and door close command. This class of door system has four signals available for monitoring; door open command, door close command, door open limit and door switch.

2) Automatic doors with door open command. This class of door system has three signals available for monitoring; door open command, door open limit and door switch.

3) Simple automatic doors—This class of door system has only two signals available for monitoring; namely, the door open command and the door switch.

The output of the door diagnostic logic is bins of data. The performance data includes:

Interval means
Interval standard deviations
Specific state counts
Abnormality counts
Normal Interval Counts per Performance Data Update
Out of sequence counts The door diagnostic logic also outputs door status:

Door Commanded Open
Door Opening
Door Open
Door Closing
Door Closed

The door state machine comprises nodes and vectors. A node is the resultant status of the door due to a sequence of events that have occurred on the door system. Each state that the elevator door can assume is represented graphically by a circle. Mnemonics used within the circle identify a node as is described herein below.

A vector is the action or path the system must take in response to a set of conditions that are presented by the inputs or some other parameter that is being monitored. Each vector has the following characteristics:

a) Goto Node—Once conditions of a vector are met the machine is updated to the new node.

b) Vector Priority—All vectors out of a node are prioritized by the vector number; the lowest number having the highest priority.

c) Vector Conditions—All vectors have the following conditions:

1) Single Input conditions—Any input could be true or false, i.e., the condition must be true before the goto vector is executed. For example, a vector can be associated to the following condition: V1:DS(T) which means vector 1 will be carried out if the signal DS equals the logical value of True. V1:DS(F) which means vector 1 will be carried out if the signal DS equals the logical value of False.

2) Multiple conditions on one vector—If multiple conditions are present for a vector, a logical "AND" of all conditions is required to update to a new node, i.e., all conditions must be true before the goto vector is executed.

d) Data Functions—Each vector is capable of outputting to the memory some output data. The following are the output capabilities of a vector:

Door Performance Data—these are used by the abnormality detection logic to determine the door performance measures.

Counts—This is count data of specific events such as:

Specific state counts—These are reported along with the performance measures.

Abnormality Counts—These are generated by the abnormality detection logic to which the vector interfaces.

Out of sequence counts

The sequences defined for each class of door types are essential to providing:

a) A means to determine proper door operation; i.e., the door followed a normal sequence of operation. For example, a door may open without a door open request; this is an incorrect sequence.

b) A means to measure raw door performance data that will be processed by the abnormality detection logic once the system is initialized.

Definitions for the mnemonics for the nodes of the state machine as follows:

TABLE I

Definition of Node Mnemonics and Discrete Input Mnemonics

| Mnemonic | Definition |
|---|---|
| DCLS | Door Closed |
| DCO | Door Commanded to Open |
| DOG | Door Opening |
| DOP | Door Open |
| DCC | Door Close Command |
| DSCG | Door Stopped Closing |
| DCDS | Door Closed Before DS |
| DNIS | Doors Not in Service |
| DSOWC | Door Started to Open without Command |
| DS | Door Switch |
| DO | Door Open Relay |
| DOL | Door Open Limit Switch |
| DC | Door Close Relay |
| INOP | Elevator Inoperative |

TABLE II

Definition of Door Performance Measure Mnemonics

| | | |
|---|---|---|
| C1 | Counter 1 - Start to Open Operations | This is the number of times a door Starts to Open |
| C2 | Counter 2 - Open Interval Operations | This is the number of times a door opens |
| C3 | Counter 3 - Dwell Operations | This is the number of times a door dwells |
| C4 | Counter 4 - Start to Close Operations | This is the number of times a door Starts to close |
| C5 | Counter 5 - Close Interval Operations | This is the number of times a door Closes |
| C6 | Counter 6 - Reversal Counter | This is the number of times a door reverses |
| C7 | Counter 7 - Door Open without Command Operation | This is the number of times a door opens without an request to open the door |
| I1 | Interval 1 - Door Interlock Interval | This is the time from when the door is requested to open to when the door lock is detected to have opened |
| I2 | Interval 2 - Door Open Interval | This is the time from when the door lock is open to when the door is full open |
| I3 | Interval 3 - Door Dwell Interval | This is the time the door is full open |
| I4 | Interval 4 -Door Start to Close Interval | This is the time from when the door is requested to close and when it begins to close |
| I5 | Interval 5 - Door Close Interval | This is the time from when the door begins to close to actually when it is closed. |

SEQUENCES OF STATE MACHINE OPERATION

Door Class 1

Figure 3:
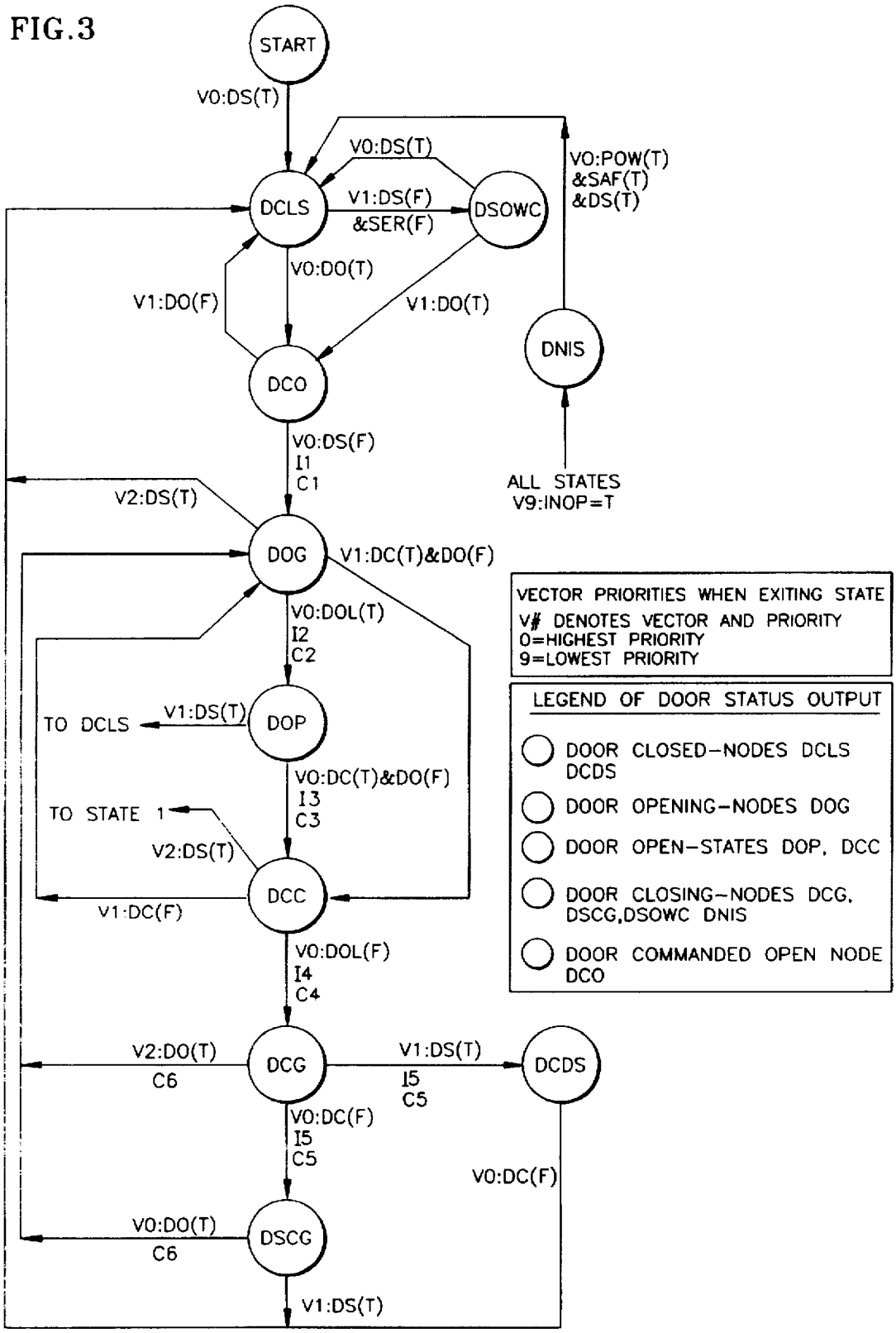
FIG. 3 is an illustration of a state machine model for a first class of elevator door systems, according to the present invention, of an elevator door system which normally operates from state-to-state in a closed loop sequential chain of normal operating states.

Referring now to FIG. 3, a state machine model of an elevator door system in which transitions from state-to-state following a typical sequence of elevator door operations for the first class of elevator door systems is shown; namely, automatic doors with door open and door close command signals. The state machine described herein, in connection with FIG. 3, in effect monitors substantially the entire sequence of operations that the elevator door performs. Thus, the state machine is the core logic and algorithm that models the normal behavior of the door system in an elevator system. If the elevator door fails to follow the normal sequence, or fails meet the criteria for transitioning between successive states representative of normal operation, an inoperative condition or a failure condition is detected by a transition out of the normal sequence of states into an inoperative or alarm state.

A detailed description of the operation of the state machine follows. Each state in the diagram of FIG. 3 is described along with the requirements and conditions for transition out of the state to another successive state. It should be understood that the actual hardware implementation of the state machine requires a programmer to encode all the requirements of the state machine in a particular language according to the particular hardware being used; however, the encoding details are not described because the particular hardware and programming techniques utilized are a matter of choice not embracing the inventive concept.

In the following description, any malfunction by the door or door controller which results in a failure to transition from a particular state in the normal sequence is detected. The specific transition out of the normal sequence is detected and identified by a transition to a particular inoperative condition. It should be kept in mind that the state machine serves a monitoring function whereas an actual failure of the elevator is the causal factor while the detection merely serves as a monitoring function of the elevator system.

START—When the system is initialized the door state machine starts at this node. This is also true for reset that may occur due to processor reset or a system reset from software. When DS(T) is observed by the system it moves to the next node.

DCLS—This node is the door closed node. Whenever the door is locked and the door chain is complete the system is in this node. A DO(T) condition will move us to the DCO node. A DS(F) Condition at this state will take the system to the DSOWC node and update Counter 7 (C7) (door opened without command counter)

DCO—This is the Door Commanded to Open node. The system is at this node whenever the door is legally requested to open. A DO(F) condition at this node will move us back to DCLS node. A DS(F) condition will move us to the DOG Node. As we move to the DOG node we update Interval 1 (I1) and counter 1 (C1).

DOG—Door Opening Node. Whenever the door is opening the system is at this node. A DOL(T) condition the system moves to the DOP state and updates I2 and C2. If a DC(T) and DO(F) condition is detected then the system moves to the DCC node and updates counter 8 (C8). If a DS(T) condition is detected then we move to node DCLS.

DOP—Door Open Node. Whenever the doors are functionally open the system is at this node. If a DC(T) and DO(F) condition are detected then the system moves to DCC node and updates I3 and C3.

DCC—Door Commanded to Close Node. Whenever the Doors are legally requested to close the system is at this node. If a DC(F) condition is detected the system returns to DOG node. If DOL(F) condition is detected the system moves to DCG node and updates I4 and C4. If a DS(T) condition is detected the system moves to DCLS node.

DCG—Door Closing Node. When the doors are in closing mode the system will be at this node. If DC(F) condition is detected the system moves to DSCG node and updates I5 and C5. If DS(T) condition is detected the system moves to DCDS node and Updates I5 and C5. IF DO(T) condition is detected the system returns to DOG state and updates the reversal counter (C6).

DSCG—Door Stopped Closing. When the system detects the Doors are closed we are at this node. When DO(T) is detected the system returns to node DOG and updates Reversal counter (C6). If DS(T) is detected then the system moves to DCLS node.

DCDS—this node represents doors closed before the Door Close Command is detected off. This node allows the system to monitor door operators that have a slightly different mode of operation where the command to close is turned off after the doors are closed. If a DC(F) (door Close relay false) condition is detected here the system moves to DCLS node.

DSOWC—Doors started to Open without command. This is a failure node. If DS(T) is detected the system returns to DCLS node. If the system observes a DO(T) condition then it moves to DCO node.

DNIS—If an external input from a supervisory system or from the elevator goes true INOP(T) is detected and the system is at this node. The door state machine will desynchronize from this failure node back to the above described sequence when it detects POW(T), SAF(T) and DS(T) and it moves to state DCLS.

Door Class 2

Figure 4:
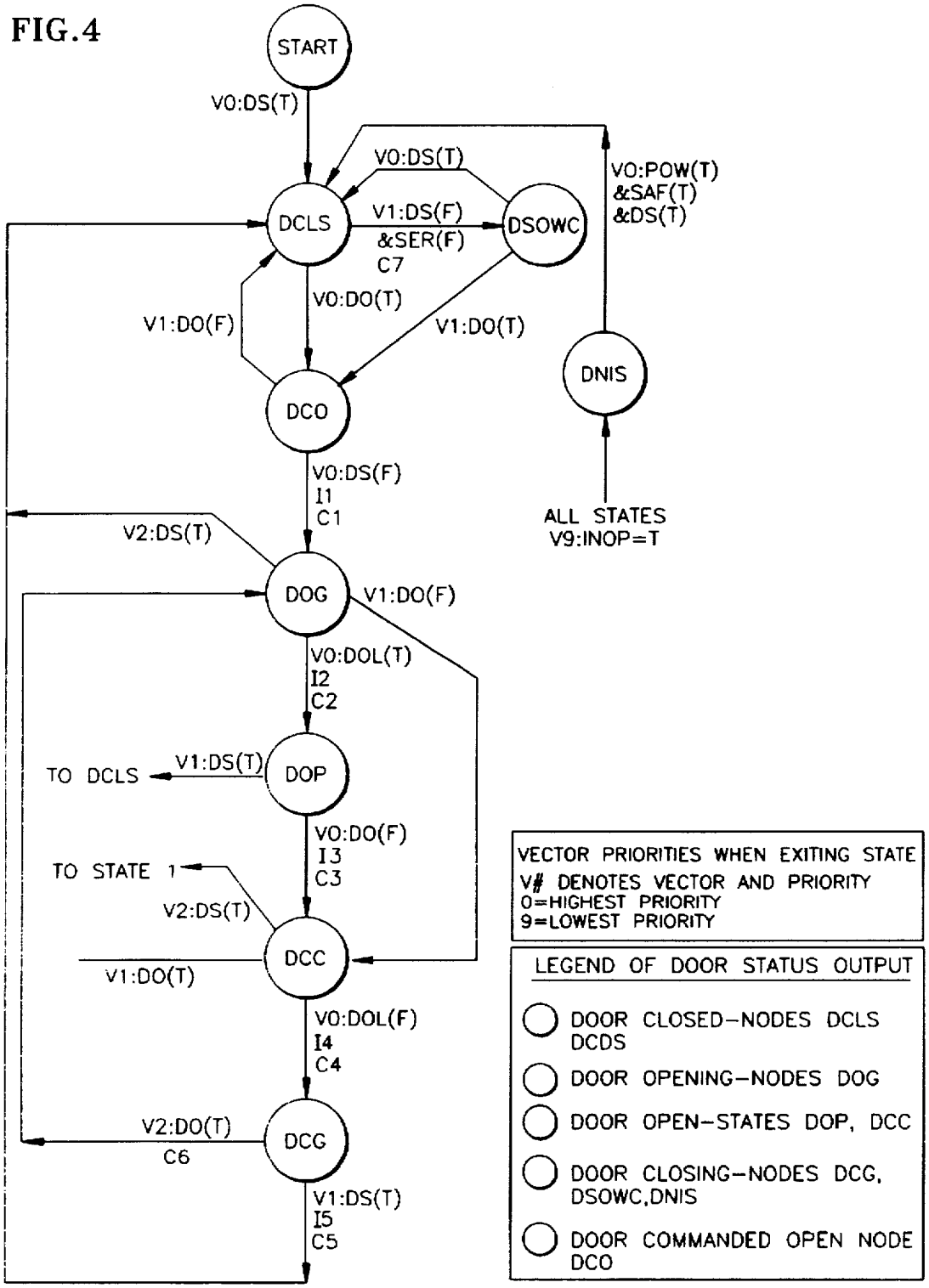
FIG. 4 is an illustration of a state machine model for a second class of elevator door systems, according to the present invention, of an elevator door system which normally operates from state-to-state in a closed loop sequential chain of normal operating states.

Referring to FIG. 4, a state machine model of an elevator door system in which transitions from state-to-state following a typical sequence of elevator door operations for the second class of elevator door systems is shown; namely, automatic doors with door open command. A detailed description of the state machine follows.

START—When the system is initialized the door state machine starts at this node. This is also true for reset that may occur due to processor reset or a system reset from software. When DS(T) is observed by the system it moves to the next node.

DCLS—This node is the door closed node. Whenever the door is locked and the door chain is complete the system is in this node. A DO(T) condition will move us to the DCO node. A DS(F) Condition at this state will take the system to the DSOWC node and update Counter 7 (C7) (door opened without command counter)

DCO—This is the Door Commanded to Open node. The system is at this node whenever the door is legally requested to open. A DO(F) condition at this node will move us back to DCLS node. A DS(F) condition will move us to the DOG Node. As we move to the DOG node we update Interval 1 (I1) and counter 1 (C1) (these will be discussed in the Performance data section).

DOG—Door Opening Node. Whenever the door is opening the system is at this node. A DOL(T) condition the system moves to the DOP state and updates I2 and C2. If a DO(F) condition is detected then the system moves to the DCC node and updates counter 8 (C8). If a DS(T) condition is detected then we move to node DCLS.

DOP—Door Open Node. Whenever the doors are functionally open the system is at this node. If a DO(F) condition are detected then the system moves to DCC node and updates I3 and C3.

DCC—Door Commanded to Close Node. Whenever the Doors are legally requested to close the system is at this node. If a DO(T) condition is detected the system returns to DOG node. If DOL(F) condition is detected the system moves to DCG node and updates I4 and C4. If a DS(T) condition is detected the system moves to DCLS node.

DCG—Door Closing Node. When the doors are in closing mode the system will be at this node. If DC(F) condition is detected the system moves to DSCG node and updates I5 and C5. If DS(T) condition is detected the system moves to node and Updates I5 and C5. IF DO(T) condition is detected the system returns to DOG state and updates the reversal counter (C6).

DSOWC—Doors started to Open without command. This is a failure node. If DS(T) is detected the system returns to DCLS node. If the system observes a DO(T) condition then it moves to DCO node.

DNIS—If an external input from a supervisory system or from the elevator goes true INOP(T) is detected and the system is at this node. The door state machine will desynchronize from this failure node back to the above described sequence when it detects POW(T), SAF(T) and DS(T) and it moves to state DCLS.

Door Class 3

Figure 5:
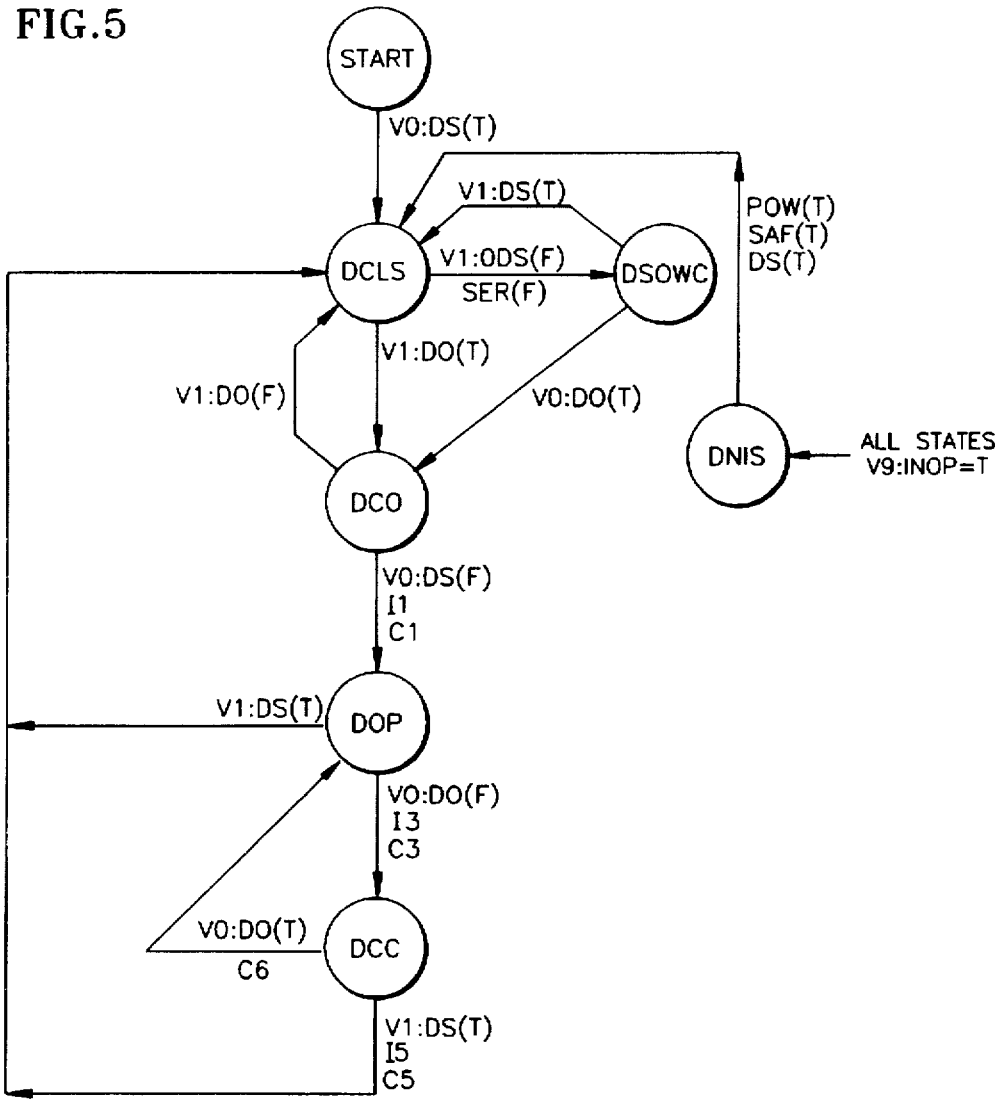
FIG. 5 is an illustration of a state machine model for a third class of elevator door systems, according to the present invention, of an elevator door system which normally operates from state-to-state in a closed loop sequential chain of normal operating states.

Referring to FIG. 5, a state machine model of an elevator door system in which transitions from state-to-state following a typical sequence of elevator door operations for the third class of elevator door systems is shown; namely, simple automatic doors. A detailed description of the state machine follows.

START—When the system is initialized the door state machine starts at this node. This is also true for reset that may occur due to processor reset or just a system reset from software. When DS(T) is observed by the system it moves to the next node.

DCLS—This node is the door closed node. Whenever the door is locked and the door chain is complete the system is in this node. A DO(T) condition will move us to the DCO node. A DS(F) Condition at this state will take the system to the DSOWC node and update Counter 7 (C7) (door opened without command counter)

DCO—This is the Door Commanded to Open node. The system is at this node whenever the door is legally requested to open. A DO(F) condition at this node will move us back to DCLS node. A DS(F) condition will move us to the DOG Node. As we move to the DOG node we update Interval 1 (I1) and counter 1 (C1) (these will be discussed in the Performance data section).

DOP—Door Open Node. Whenever the doors are functionally open the system is at this node. If a DO(F) condition are detected then the system moves to DCC node and updates I3 and C3.

DCC—Door Commanded to Close. When the doors are in closing mode the system will be at this node. If DC(F) condition is detected the system moves to DSCG node and updates I5 and C5. If DS(T) condition is detected the system moves to DCDS node and Updates I5 and C5. IF DO(T) condition is detected the system returns to DOG state and updates the reversal counter (C6).

DSOWC—Doors started to Open without command. This is a failure node. If DS(T) is detected the system returns to DCLS node. If the system observes a DO(T) condition then it moves to DCO node.

DNIS—If an external input from a supervisory system or from the elevator goes true INOP(T) is detected and the system is at this node. The door state machine will desynchronize from this failure node back to the above described sequence when it detects POW(T), SAF(T) and DS(T) and it moves to state DCLS.

Initialization

For a given operator the first n door operations that go through the correct sequence of discrete events are defined as "valid operations". The advantage of verifying the sequence of operation is twofold. First, empirical elevator knowledge is used to determine whether a normal door operation occurred. Second, non-normal door operations such as reversals are automatically removed from the initial data set. The median of the sorted timings from the first n "valid operations" at each door, can be computed as an estimate of the real mean. This initial mean, in one embodiment, is used as a reference measure. An estimate of the standard deviation is obtained by the median of the sorted data set (estimated mean). This initial standard deviation, in one embodiment, is used as an initial acceptable range for a performance measure and is determined in response to the reference measure. The advantages of this initialization routine are that it is flexible, accurate, and statistically robust. Accordingly, the purpose of the initialization logic is to provide a reference measure as a starting point for the performance measure, and to provide the acceptable range for the performance measure.

Median Filter Technique

The median filter technique requires a series of data points to be collected and stored into a table. When the table is full (number of data points=n), the data is sorted. The median point, in the sorted data, is used as an approximation of the initial mean point which is defined as the reference measure.

The initial acceptable range is a fraction of the variance of the data points within the table. The initial acceptable range for abnormality detection is determined as follows:

$$StD_i = \sqrt{\frac{n}{n-1}\ \text{median}\ |(x_i - x_m)|}$$

where:

$x_i$=data point $x_m$=median point (reference measure)

n=width of data set

A sample calculation of the starting mean and standard deviation technique is as follows:

1) Data points are collected and stored in the table.

| | | | | | | | | | | |
|---|---|---|---|---|---|---|---|---|---|---|
| 3.25 | 3.45 | 3.10 | 3.25 | 3.96 | 2.96 | 3.56 | 4.01 | 3.67 | 3.12 | 3.80 |

2) When the table is full the data points are sorted.

| | | | | | | | | | | |
|---|---|---|---|---|---|---|---|---|---|---|
| 2.96 | 3.10 | 3.12 | 3.25 | 3.25 | 3.45 | 3.56 | 3.67 | 3.80 | 3.96 | 4.01 |

3) Median point = 3.45

4) Standard deviation calculation.

-continued

| $X_{ref}$ | $X_i$ | $\lvert X_{ref} - X_i \rvert$ | $\lvert X_{ref} - X_i \rvert$ sorted |
|---|---|---|---|
| 3.45 | 2.96 | .49 | .00 |
| 3.45 | 3.10 | .35 | .11 |
| 3.45 | 3.12 | .33 | .20 |
| 3.45 | 3.25 | .20 | .20 |
| 3.45 | 3.25 | .20 | .22 |
| 3.45 | 3.45 | .00 | .33 |
| 3.45 | 3.56 | .11 | .35 |
| 3.45 | 3.67 | .22 | .35 |
| 3.45 | 3.80 | .35 | .49 |
| 3.45 | 3.96 | .51 | .51 |
| 3.45 | 4.01 | .56 | .56 |

$$StD_i = \sqrt{1.1}\ (.33) = .35$$

Application of the Median Filter Technique

The door diagnostics logic requires an initial mean and standard deviations to be established for each interval. Initial values only have to be established if the system has not been initialized. In one embodiment, the width of the median filter is eleven points.

The door state machine is used to filter erroneous data points from median filter logic. Data points collected from abnormal state sequences are not stored in the median filter table. The first eleven normal door operations, at any floor, are used in this embodiment to establish the initial mean and standard deviation values for all doors.

Abnormality Detection Logic

Mean and Standard Deviation Calculation

During steady state operation the mean and standard deviation values are updated using a continuous filter technique.

The new mean $A_t$ is continuously updated by taking a fraction of the old mean $A_{t-1}$, plus a fraction of the new data point $X_t$. Thus, a new processed performance measure ("performance result") for any given interval is determined as follows:

$$A_t = \left(\frac{n-1}{n}\right) * A_{t-1} + \left(\frac{1}{n}\right) * X_t$$

where:

t is the present time, t−1 is the time of previous evaluation, $X_t$ is the performance measure, $A_t$ is the performance result, and n is the number of values in the average, also defined as the width of the filter. In one embodiment, the range the width of the filter ranges from 1 to 20.

The new mean ("performance result") $A_t$ is used to calculate new standard deviation $StD_t$. The standard deviation $StD_t$ for abnormality determination is derived as follows:

$$StD_t = \sqrt{\left(\frac{n-1}{n}\right) * (StD_{t-1})^2 + \left(\frac{1}{n}\right) * (A_t - X_t)^2}$$

Only the immediately preceding values of the mean, $A_{t-}$, and standard deviation, $StD_{t-1}$, need be recorded in order to determined the current values of $A_t$ and $StD_t$.

Abnormality Determination

Abnormalities in the interval data from the state machine are data points that differ from the mean by a multiple G of the standard deviations $StD_t$. Thus, an acceptable range of G* $StD_t$ is used to determine abnormalities. The relationship is as follows:

IF $$(\lvert A_{t-1} - X_t \rvert) \geqq G * StD_{t-1}$$

THEN $X_t$ is an abnormality

The acceptable range has a minimum value in order to prevent all data points being determined as abnormal. For example, if the acceptable range reaches zero then all data points will be outside of the acceptable range. In one embodiment, the minimum value is proportional to the sample rate of the performance measures.

Additionally, if the number of abnormalities is greater than a determined number then the acceptable range is increased by a determined percentage. In one embodiment, the determined number is fifty percent of a total number of iterations. Abnormalities are not considered in the calculations of new mean and standard deviation.

Gain Factor (G)

The gain factor is used to determine the number of standard deviations away from the mean a data point can be before it is classified an abnormality. In one embodiment, the gain in the door diagnostics logic is set to eleven.

Output Processing

Door Performance Measures

The counts, interval means and standard deviations are transferred to data storage for each performance data update. A performance data update occurs after the system detects a predetermined number of door operations so that the performance result may be further refined. In one embodiment, the predetermined number of times is 50. The data are stored in performance bins that are eventually sent to the local office for data analysis and maintenance scheduling. Counters are updated by adding one to the previously stored count. Intervals are stored in a working bin and when a performance update occurs the interval data is averaged and both the mean and standard deviation is stored in memory.

Door Status Outputs

According to each sequence of the various door state machine models, every time the door state machine updates to a new node, the door status is updated with a new door status according to the following table:

TABLE II

| Node Mnemonic | Door Status Output |
|---|---|
| START | None |
| DCLS | Door Closed |
| DCO | Door Commanded to Open |
| DOG | Door Opening |
| DOP | Door Open |
| DCC | Door Open |
| DCG | Door Closing |

TABLE II-continued

| Node Mnemonic | Door Status Output |
|---|---|
| DSCG | Door Closing |
| DCDS | Door Closing |
| DSOWC | Door Closing |
| DNIS | Door Closing |

The door performance results and the door status outputs are useful in determining the existence of an alarm condition, determining the cause of the alarm condition and prevention of future alarm conditions.

Thus, the present invention provides the advantage of accurately monitoring elevator door performance results in addition to monitoring alarm conditions caused by elevator door faults; this allows for the detection of elevator door system degradation over a period of time. Additionally, the present invention provides the ability to a plurality of different elevator door systems having a plurality of different parameter signals to be monitored.

Various changes to the above description may be made without departing from the spirit and scope of the present invention as would be obvious to one of ordinary skill in the art of the present invention.

What is claimed is:

1. A method for providing an elevator door performance result of an elevator door in an elevator system, said method comprising the steps of:

determining a reference measure for the elevator door;

determining an acceptable range for a performance measure in response to the reference measure;

providing the performance measure from a door state machine which monitors a plurality of parameter signals provided by the elevator door system, the door state machine following a sequence of elevator door operations;

determining if the performance measure is within the acceptable range; and providing a performance result by averaging the performance measure with the reference measure if the performance measure is within the acceptable range, wherein the performance measure is not considered in providing the performance result if the performance measure is not within the acceptable range.

2. A method for providing an elevator door performance result of an elevator door in an elevator system as recited in claim 1 wherein the performance result is determined in accordance with the following:

$$A_t = \left(\frac{n-1}{n}\right) * A_{t-1} + \left(\frac{1}{n}\right) * X_t$$

wherein t is the present time, t−1 is the time of previous evaluation, $X_t$ is the performance measure, $A_t$ is the performance result, and n is the number of values in the average.

3. A method for providing an elevator door performance result of an elevator door in an elevator system as recited in claim 2 wherein the number of values in the average ranges from one to twenty.

4. A method for providing an elevator door performance result of an elevator door in an elevator system as recited in claim 1 wherein the acceptable range is determined in accordance with the following:

$$\text{Acceptable Range} = G * StD_t = \sqrt{\left(\frac{n-1}{n}\right) * (StD_{t-1})^2 + \left(\frac{1}{n}\right) * (A_t - X_t)^2}$$

wherein t is the present time, t−1 is the time of previous evaluation, $X_t$ is the performance measure, $A_t$ is the performance result, $StD_t$ is the standard deviation, G is a gain factor, and n is the number of values in the average.

5. A method for providing an elevator door performance result of an elevator door in an elevator system as recited in claim 4 wherein the number of values in the average ranges from one to twenty.

6. A method for providing an elevator door performance result of an elevator door in an elevator system as recited in claim 1 further comprising the step of:

providing an updated acceptable range in response to the average of the performance measure and the reference measure.

7. A method for providing an elevator door performance result of an elevator door in an elevator system as recited in claim 6 wherein each step is repeated a determined number of iterations so as to further refine the performance result.

8. A method for providing an elevator door performance result of an elevator door in an elevator system as recited in claim 7 wherein if a number of occurrences of the performance measure not being in the acceptable range is greater than a determined number then the acceptable range is increased by a determined percentage.

9. A method for providing an elevator door performance result of an elevator door in an elevator system as recited in claim 8 wherein the determined number is fifth percent of the determined number of iterations.

10. A method for providing an elevator door performance result of an elevator door in an elevator system as recited in claim 8 wherein the determined percentage is ten percent.

11. A method for providing an elevator door performance result of an elevator door in an elevator system as recited in claim 7 wherein the determined number of iterations is 50.

12. A method for providing an elevator door performance result of an elevator door in an elevator system as recited in claim 1 wherein the performance measure is a door interlock interval.

13. A method for providing an elevator door performance result of an elevator door in an elevator system as recited in claim 1 wherein the performance measure is a door open interval.

14. A method for providing an elevator door performance result of an elevator door in an elevator system as recited in claim 1 wherein the performance measure is a door dwell interval.

15. A method for providing an elevator door performance result of an elevator door in an elevator system as recited in claim 1 wherein the performance measure is a door start to close interval.

16. A method for providing an elevator door performance result of an elevator door in an elevator system as recited in claim 1 wherein the performance measure is a door close interval.

17. A method for providing an elevator door performance result of an elevator door in an elevator system as recited in claim 1 wherein the parameter signals monitored by the door state machine comprise a door open command signal and a door switch signal.

18. A method for providing an elevator door performance result of an elevator door in an elevator system as recited in claim 17 wherein the parameter signals monitored by the door state machine further comprise a door open limit signal.

19. A method for providing an elevator door performance result of an elevator door in an elevator system as recited in claim 18 wherein the parameter signals monitored by the door state machine further comprise a door close command signal.

20. A method for providing an elevator door performance result of an elevator door in an elevator system as recited in claim 1 wherein the performance result is communicated from a building in which the elevator system resides to a monitoring center for determining degradation in the performance result.

21. An apparatus for providing an elevator door performance result of an elevator door in an elevator door system which normally operates sequentially from state-to-state in a closed loop sequential chain of normal operating states, said apparatus monitoring a plurality of parameter signals provided by the elevator door system, said apparatus comprising:

a door state sequencer for providing a performance measure in response to a plurality of parameter signals provided by the elevator door system;

a module for providing a reference measure and an acceptable range for the door performance measure in response to the sequential chain of normal door operating states; and an abnormal detection module for analyzing the door performance measure such that if the door performance measure is within the acceptable range a performance result is provided by averaging the performance measure with the reference measure.

22. An apparatus for providing an elevator door performance result of an elevator door in an elevator door system as recited in claim 21 wherein the acceptable range is updated in response to the performance result.

23. An apparatus for providing an elevator door performance result of an elevator door in an elevator door system as recited in claim 21 wherein if the door performance measure is not within the acceptable range, the door performance measure is ignored.

24. An apparatus for providing an elevator door performance result of an elevator door in an elevator door system as recited in claim 21 wherein the performance result is determined in accordance with the following:

$$A_t = \left(\frac{n-1}{n}\right) * A_{t-1} + \left(\frac{1}{n}\right) * X_t$$

wherein t is the present time, t−1 is the time of previous evaluation, $X_t$ is the performance measure, $A_t$ is the performance result, and n is the number of values in the average.

25. A method for providing an elevator door performance result of an elevator door in an elevator system as recited in claim 24 wherein the number of values in the average ranges from one to twenty.

26. An apparatus for providing an elevator door performance result of an elevator door in an elevator door system as recited in claim 21 wherein the acceptable range is determined in accordance with the following:

$$\text{Acceptable Range} = G * StD_t = \sqrt{\left(\frac{n-1}{n}\right) * (StD_{t-1})^2 + \left(\frac{1}{n}\right) * (A_t - X_t)^2}$$

wherein t is the present time, t−1 is the time of previous evaluation, $X_t$ is the performance measure, $A_t$ is the performance result, $StD_t$ is the standard deviation, G is a gain factor, and n is the number of values in the average.

27. A method for providing an elevator door performance result of an elevator door in an elevator system as recited in claim 26 wherein the number of values in the average ranges from one to twenty.

28. An apparatus for providing an elevator door performance result of an elevator door in an elevator door system as recited in claim 21 wherein the performance measure is a door interlock interval.

29. An apparatus for providing an elevator door performance result of an elevator door in an elevator door system as recited in claim 21 wherein the performance measure is a door open interval.

30. An apparatus for providing an elevator door performance result of an elevator door in an elevator door system as recited in claim 21 wherein the performance measure is a door dwell interval.

31. An apparatus for providing an elevator door performance result of an elevator door in an elevator door system as recited in claim 21 wherein the performance measure is a door start to close interval.

32. An apparatus for providing an elevator door performance result of an elevator door in an elevator door system as recited in claim 21 wherein the performance measure is a door close interval.

33. An apparatus for providing an elevator door performance result of an elevator door in an elevator door system as recited in claim 21 wherein the parameter signals monitored by the door state sequencer comprise a door open command signal and a door switch signal.

34. An apparatus for providing an elevator door performance result of an elevator door in an elevator door system as recited in claim 33 wherein the parameter signals monitored by the door state sequencer further comprise a door open limit signal.

35. An apparatus for providing an elevator door performance result of an elevator door in an elevator door system as recited in claim 34 wherein the parameter signals monitored by the door state sequencer further comprise a door close command signal.

36. An apparatus for providing an elevator door performance result of an elevator door in an elevator door system as recited in claim 21 wherein the performance result is communicated from a building in which the elevator system resides to a monitoring center for determining degradation in the performance result.

* * * * *